US006844798B2

(12) United States Patent
Apte et al.

(10) Patent No.: US 6,844,798 B2
(45) Date of Patent: Jan. 18, 2005

(54) DEVICE FOR TRANSMITTING ELECTROMAGNETIC WAVES THROUGH AN APERTURE IN A WALL

(75) Inventors: Prasad Apte, East Amherst, NY (US); Wendell W. Isom, Grand Island, NY (US); Michael M. Litwin, Cheektowaga, NY (US)

(73) Assignee: Praxair Technology, Inc., Danbury, CT (US)

( * ) Notice: Subject to any disclaimer, the term of this patent is extended or adjusted under 35 U.S.C. 154(b) by 52 days.

(21) Appl. No.: 10/299,964

(22) Filed: Nov. 19, 2002

(65) Prior Publication Data

US 2004/0095215 A1 May 20, 2004

(51) Int. Cl.[7] ..... H01P 1/08
(52) U.S. Cl. ..... 333/252
(58) Field of Search ..... 333/252

(56) References Cited

U.S. PATENT DOCUMENTS 3,345,535 A * 10/1967 Johnson et al. ..... 315/39
3,781,726 A * 12/1973 Thompson ..... 333/252
4,688,009 A * 8/1987 Ferguson et al. ..... 333/252
5,175,523 A * 12/1992 Huey et al. ..... 333/252

* cited by examiner

*Primary Examiner*—Benny Lee
(74) *Attorney, Agent, or Firm*—Iurie A. Schwartz

(57) ABSTRACT

A device for efficient transmission of electromagnetic waves comprising two layers of dielectric separated by a gap or space. The layers may be uniform or laminar, orthogonal or non-orthogonal to the direction of wave propagation, and made of Teflon, quartz, polypropylene, and the like. The preferred distance between layers is an odd multiple of quarter wavelength in the environment between the layers. The preferred thickness of the layers is an odd multiple of half of the effective wavelength for the layer. The device allows over 95% efficiency for transmission into a pressurized vessel for evaporation under high pressure and temperature and does not require a cooling system. The separating space may be connected with a pressure-sensing subsystem to monitor the device's integrity and shut down the system in the event of a breach. A sleeve connecting the device to the vessel may be coated with conductive material for improved efficiency.

16 Claims, 2 Drawing Sheets

DEVICE FOR TRANSMITTING ELECTROMAGNETIC WAVES THROUGH AN APERTURE IN A WALL

BACKGROUND OF THE INVENTION

This invention generally relates to transmission of electromagnetic waves between two regions divided by a solid window penetrable by the electromagnetic waves. The electromagnetic properties of the window are generally different from the properties of the matter that makes contact with the windows. The general purpose is to transmit through the window the maximum amount of energy carried by the electromagnetic waves, i.e., to minimize the dispersion, reflection, and dissipation, at the same time maintaining the structural integrity of the window.

More specifically, a microwave-based evaporator/vaporizer has a waveguide coupled to a high-pressure vessel. A docking collar safety device is positioned between the waveguide and the high-pressure vessel. The evaporator/vaporizer system vaporizes liquefied compressed gases such as ammonia (or other similar liquid) at high flow rates. The gases are usually under moderate to high pressure and can be toxic or hazardous if exposed to the atmosphere. The microwave evaporator for an ammonia application typically operates at 114 psig.

The docking collar or a safety device must efficiently pass microwaves into the vessel and provide a pressure barrier to prevent high pressure and toxic gases from escaping from the vessel in undesired ways. The following prior art apparatuses use double window assemblies specially designed for their application. None imply or suggest the present invention.

European Patent 0,614,575 B1 and U.S. Pat. No. 5,200,722 disclose a dual window assembly adapted to uniformly transmit high power microwave energy from a source, such as a waveguide, at atmospheric pressure into the interior of a vacuum deposition etch chamber. Cooling fluid passes inside the narrow gap between the two windows to reduce the temperature of the windows positioned in the wall of the vacuum chamber to allow high power microwaves to pass without producing thermal failure of windows even over extended periods of time.

European Patent 0,505,066 B1 and U.S. Pat. No. 5,175,523 pertain to vacuum-sealed dual dielectric windows for transmitting electromagnetic waves between sections of a waveguide containing different atmospheres, such as a high-vacuum electron tube (such as a klystron or a gyrotron) and a pressurized waveguide. Each window is a plate of thickness equal to about one half of a wavelength in the dielectric-filled guide transmitting transverse electric wave $TE_{011}$, so that the reflections at the two faces add out of phase and cancel at the center frequency. The two windows are displaced by one-quarter wavelength of the evacuated or coolant-filled guide giving a similar cancellation. The window assembly comprises two parallel dielectric plates, spaced apart, with coolant flow confined between them. Since high coolant flow and pressure is needed at very high microwave power levels, the dielectric plates (windows) are required to be as thin as possible at high frequency. On the other hand, the existing stresses can cause failures of the dielectric plates. Applying an inward force between the plates reduces the stress in the dielectric plates by a coaxial structure at the axial center of the plates where the electromagnetic field is low.

European Patent 0,343,594 B1 and U.S. Pat. No. 4,965,541 relate to an improved waveguide provided with double disk window assembly having microwave-transmitting dielectric disks. The disks are spaced as close as possible to each other. A coolant flows in the gap between the dielectric disks cooling the disk window assembly. A waveguide employs this transmission window, for example, in the output section of a microwave electron tube (such as a klystron, a traveling wave tube, and a gyrotron or microwave transmission line of a particle accelerator). To increase the operating frequency of the waveguide, the double-faced disk cooled window assembly of that waveguide has to employ thin dielectric disks for wide pass band performance. If the thickness of the dielectric disks is increased, the pass band of the microwaves will be narrow.

U.S. Pat. No. 4,286,240 pertains to high power microwave transmission and discloses an apparatus for conducting very high microwave power at very high frequencies. A circular waveguide transmitting a circular electric field mode is used. The vacuum-tight window of an electron tube is often the element with the lowest power-handling capability. The patent discloses a window that has two dielectric plates with a space between them. There is a gap in the waveguide inner wall through which a dielectric fluid is circulated between plates to cool them. The gap leads to a region containing wave-absorbing material, such as water, to absorb modes other than the circular electric-field mode.

U.S. Pat. No. 5,455,085 relates to a window for coupling electromagnetic energy through a wall and between two waveguides, particularly between two environments such as a high-pressure environment and a low-pressure environment. The window has two panes spaced apart by a quarter wavelength for inhibiting reflection and a construction permitting easy disassembly for replacement of components for adapting the window to different frequencies of radiation. The window is suitable for use in satellite communications wherein alignment and test of satellite electronics is to occur in a laboratory on earth while the satellite electronics may be mounted within a vacuum chamber to simulate the environment of outer space.

Accordingly, to date there exists a need for a docking collar/safety device that:

1. Efficiently transmits up to 30 kW of microwave power ranging from 915 MHz to 18000 MHz via a waveguide system into an evaporator vessel containing liquefied compressed gases, such as ammonia.

2. Provides an adequate pressure barrier to block the vaporized gas under high pressure from escaping into the waveguide system or immediate environment.

3. Has an optimized design minimizing heat loss dissipation.

4. Alerts an operator if a pressure breach at the interface of the waveguide and vessel occurs and allows a controlled shutdown of the microwave-based evaporation system.

SUMMARY OF THE INVENTION

The present invention addresses the needs and problems of the prior art. In particular, the present invention provides a device highly transparent to electromagnetic waves. The device is formed by two substantially parallel layers/plates of dielectric material separated by a layer of vacuum or a gap or space filled with another dielectric, effectively creating a third layer of dielectric material. In a preferred embodiment, the dielectric in the gap is air, but it can generally be any homogeneous substance, effectively serving as a third layer of dielectric.

The thickness of the two layers/plates and the size of the gap, space, or the third layer between them are chosen to maximize transparency of the device for the wavelength range of the incident electromagnetic waves. This in turn maximizes the amount of power transmitted through the device. The two layers/plates may be uniform in structure or formed of several layers. The thickness of uniform layers/plates is an odd multiple of one half of the dominant wavelength of the incident electromagnetic waves in the layer/plate material. The distance between the uniform layers/plates is an odd multiple of one quarter of the dominant wavelength of the incident electromagnetic waves in the third layer/gap environment. The thickness of multi-layer plates and the distance between them is determined as described for the uniform layers/plates but instead of using dielectric constant of a substance for determining the wavelength within it, the aggregate dielectric constant for each multi-layer plate is used to determine the effective wavelength. This configuration results in a power transmission efficiency of over 95%.

In a preferred embodiment, a microwave safety-docking collar provides a pressure barrier between two environments and provides nearly transparent transmission of microwave power into a high-pressure vessel containing hazardous substances.

The invented safety-docking collar further provides a safety barrier from exposure to toxic fluids held within the vessel. All wetted parts are compatible with the contact fluid.

In the preferred embodiment of the invention, the incident waves are in the microwave range usually with the frequency of about 2450 MHz, but the invention can be practiced using different parts of the electromagnetic spectrum.

In the preferred embodiment of the invention, the layers/plates and the mounting means are able to withstand pressures of up to 265 psi and temperatures of up to 200° C. maintained in a stainless-steel vessel coupled to the device. The vessel's content may include $NH_3$, HF, $SiHCl_3$, $SiH_2Cl_2$, $C_4H_8$, $C_3F_8$, HBr, $C_5F_8$, $ClF_3$, TEOS (tetraethylorthosilicate), and other liquids and gases.

In the preferred embodiment of the invention, the plates are made of quartz and Teflon, but any other dielectric material or materials capable of meeting the aforementioned heat, pressure, chemical compatibility, and electromagnetic wave transmission requirements can be used in other embodiments. The plates do not have to be of uniform or identical material composition.

In accordance with one aspect, the invention can be used without additional cooling means even at high rates of power transmission. One embodiment of the invention was practiced at a level of 30 kW and higher, but in other embodiments this range may be different.

In accordance with another aspect, the gap or the third layer between the two layers/plates may be equipped with a pressure sensing port to accommodate a pressure sensor. The pressure sensor monitors the structural integrity of the dielectric layers/plates and improves operational safety. In a preferred embodiment of the invention, a pressure-sensing device connected to the pressure sensing port shuts the microwave or vaporizing system down in the event of a pressure breach of the dielectric layer/plate or gasket material in contact with the high-pressure vessel.

In the preferred embodiment of the invention, a gold plated sleeve or flange is positioned between the dielectric layer/plate in contact with the vessel's content and the wall of the vessel. This further improves the transmission efficiency of the invention device.

A further object of the present invention is to provide material of construction and geometric configuration, which minimize the refractive index (n) or dielectric constant ($n^2$) and dielectric loss ($\epsilon''$), which results in heat production. Metal parts include aluminum or other suitable conductive metal for main docking collar sections and interface with a stainless steel sleeve with gold plating or conductive plating that coats the sleeve's inner surface conducting microwaves. All metal surfaces meet ASME pressure handling requirements and are compatible with fluid in the vessel. Gasket material is also compatible with the fluid in the vessel, nearly transparent to microwaves, and provides a good pressure seal.

BRIEF DESCRIPTION OF THE DRAWINGS

The foregoing and other objects, features and advantages of the invention will be apparent from the following more particular description of preferred embodiments of the invention, as illustrated in the accompanying drawings in which like reference characters refer to the same parts throughout the different views. The drawings are not necessarily to scale, emphasis instead being placed upon illustrating the principles of the invention.

DETAILED DESCRIPTION OF THE INVENTION

A description of preferred embodiments of the invention follows.

Figure 1:
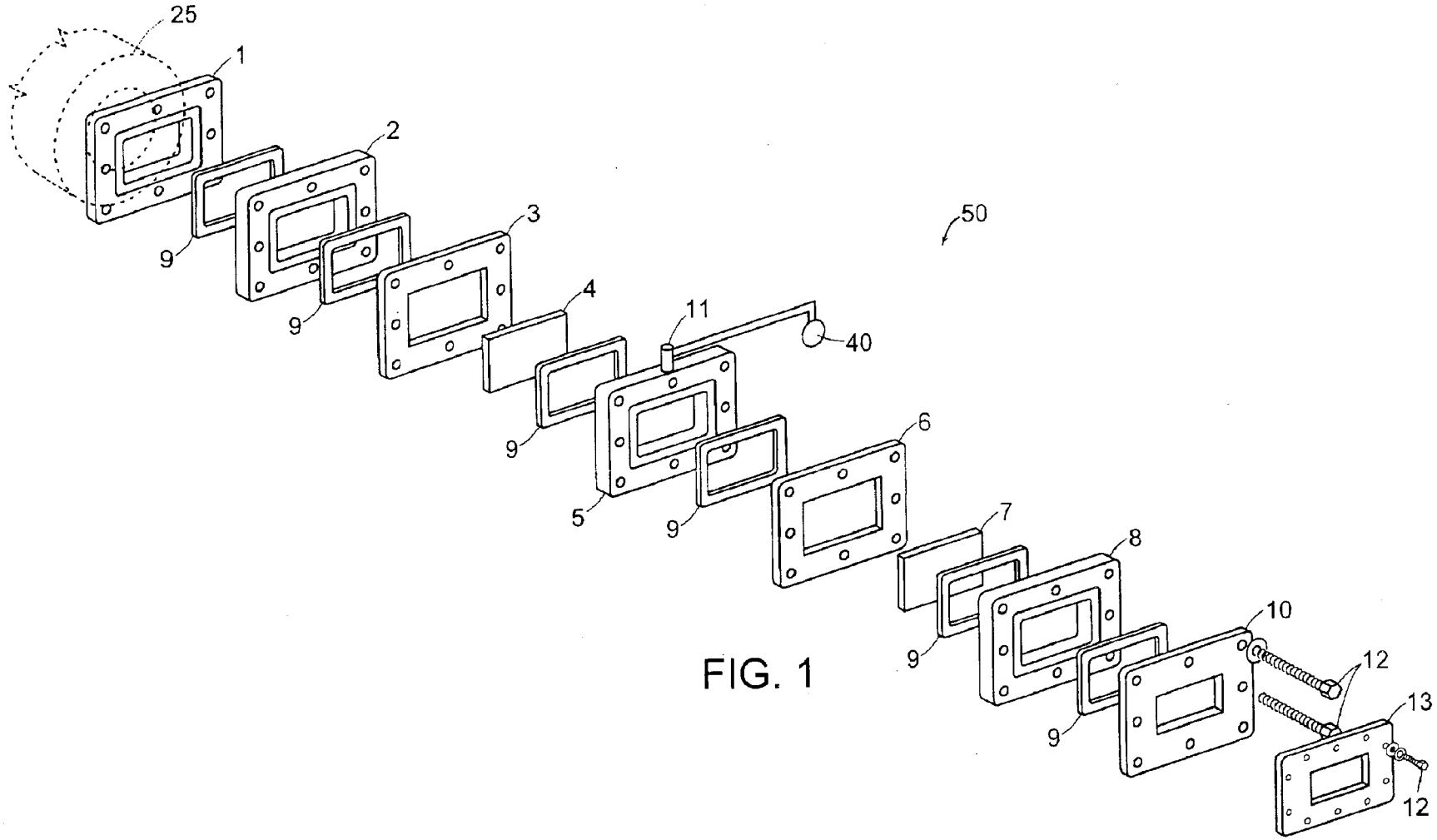
FIG. 1 is an exploded view of a device implementing the present invention.
Figure 2:
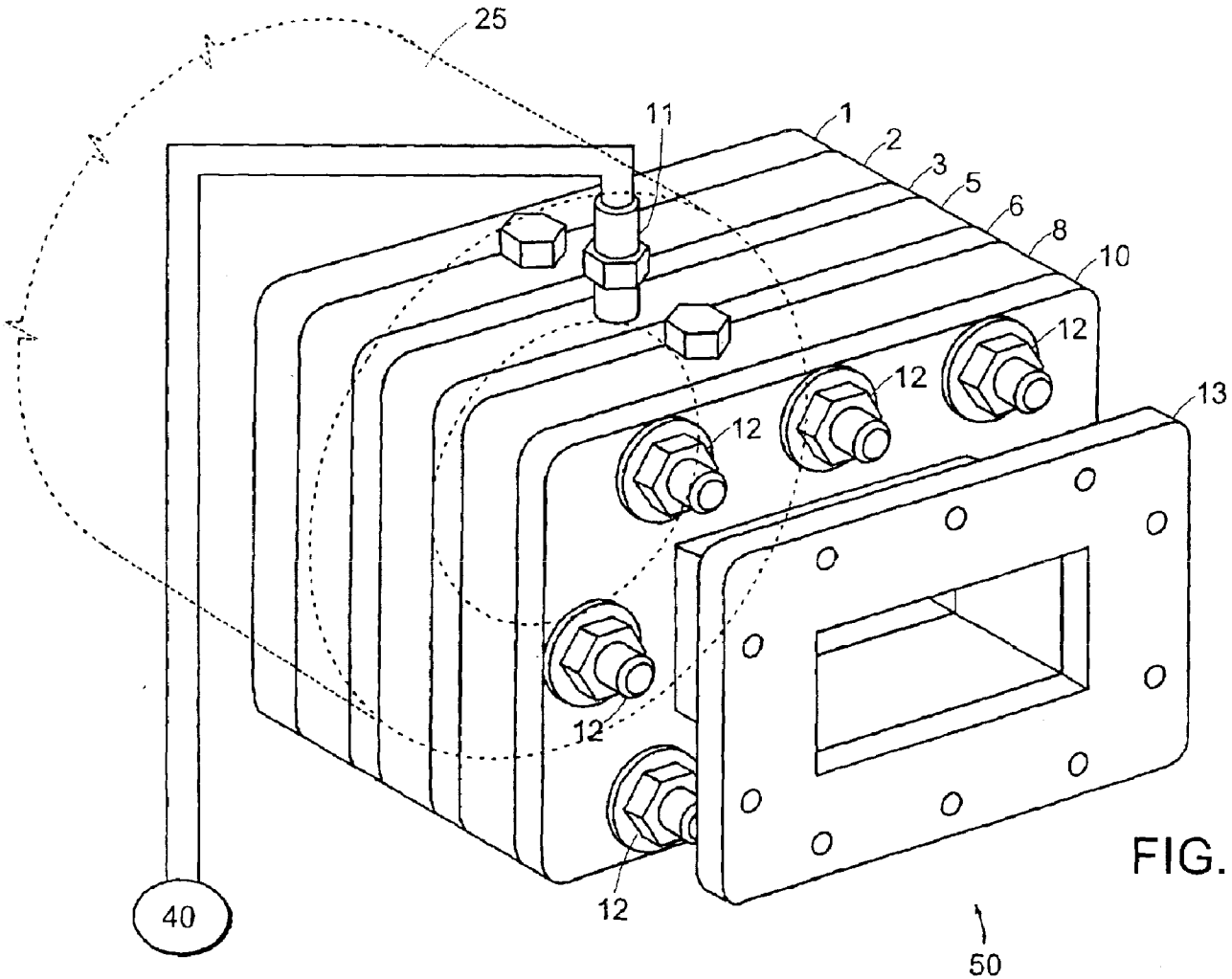
FIG. 2 is a perspective view of a device implementing the present invention.

FIGS. 1 and 2 show a preferred embodiment of the invention for microwave evaporation of liquid $NH_3$ in a pressurized stainless steel vessel with a capacity of approximately 300 gallons under pressure of up to 265 pounds per square inch and temperature of up to 200° C. Microwaves within the range of 2425 to 2475 MHz generated by a 30 kW microwave generator (e.g., a magnetron) enter the device 50 via a section of a waveguide 13 through an aluminum docking collar 10 and an aluminum flange 8. As shown in FIG. 1, the microwaves pass through a dielectric plate 7 mounted in an aluminum frame 6 orthogonal to the microwaves' trajectory. After passing through the dielectric plate 7, the microwaves pass through the gap formed by an aluminum collar 5 and then pass through a second dielectric plate 4 mounted in a respective aluminum frame 3 orthogonal to the microwaves' trajectory. The framed dielectric plates 4 and 7 serve as dual windows spaced apart by a gap. The distance or spacing of the gap is defined by thickness of collar 5 and of O-ring gaskets 9, further described below.

The aluminum collar 5 is equipped with machined pressure sensing port 11 about 0.125 inches in diameter.

After passing through the second dielectric plate 4, the microwaves pass through an aluminum docking collar 2 and enter the inside of the pressurized vessel 25 through a vessel sleeve or flange 1 welded to the vessel opening. In one embodiment, this flange or sleeve 1 is made of stainless steel. The interior of vessel sleeve 1 is gold plated to a thickness of about 0.001 inch to increase its conductivity.

The entire assembly 50 is held together with metal bolts 12 and further sealed against gas leakage by silicon rubber O-ring gaskets 9 (these gaskets are preferably Parker Number 2-240 and 2-250 used for inner and outer seals). Bolts 12 are chosen to withstand the pressures and are spaced to promote the integrity of the overall assembly.

The dielectric plates 4 and 7 are preferably made of quartz or Teflon polytetrafluoroethylene. Their thickness is equal or close to an odd multiple of the half-wavelength of the incident microwaves within their material. This thickness is also sufficient to withstand the pressure from within the vessel. For Teflon, the preferred thickness is about 1.75 inch. For quartz, the preferred thickness is about 0.75 inch.

The inside openings of the frames 3 and 6 are slightly larger (about 0.03 inch) in each direction than the corresponding dielectric windows/plates 4 and 7 mounted in them to allow for fit and expansion. The frames 3 and 6 are slightly thicker (about 0.01 inch) than the corresponding dielectric plates 4 and 7.

The thickness of the collar 5 is chosen so that the resulting length of the gap between the dielectric plates 4 and 7 is equal or close to an odd multiple of the quarter-wavelength of the incident microwaves within the air filling the gap. This geometry in combination with low dielectric loss provides a good impedance match to the vessel.

The foregoing configuration provides a power transmission efficiency of over 95%, a low power dissipation, and a low internal heat generation. As a consequence, the air surrounding the device 50 may serve as the sole source of cooling, i.e. only convective external cooling by air is necessary for the device 50 functioning. That is, no cooling fluids or other cooling subsystem/devices are needed in contrast to the prior art dual window devices.

In the preferred embodiment of the invention, a pressure-sensing device 40 connected to the pressure sensing port 11 shuts down the microwave generator and/or takes other safety measures in the event of a detected pressure breach of the dielectric plate 4 to prevent damage to the system and potential leak of dangerous substance from the vessel 25 into the environment. Various pressure sensor devices or subsystems 40 known in the art are suitable here.

In addition to the embodiment illustrated on FIGS. 1 and 2, the invention may be used in a variety of other ways.

In other embodiments, the invention can be used to efficiently transmit electromagnetic waves between elements other than a waveguide and an evaporator, e.g., between two waveguides or equivalent elements, and for electromagnetic waves in any range and at any level of transmitted power.

In other embodiments, the invention can be used with vessels of any volume, made with any material under any temperature and pressure. The purpose of the equipment on which the invention is practiced is not limited to evaporation of the vessel's content but can be any process where there is a need to transmit electromagnetic waves for energy transfer or other purposes.

In other embodiments of the invention, the content of the vessel 25 may include $NH_3$, HF, $SiHCl_3$, $SiH_2Cl_2$, $C_4H_8$, $C_3F_8$, HBr, $C_5F_8$, $ClF_3$, TEOS (tetraethylorthosilicate), and/or other liquids and gases.

In other embodiments of the invention, as appropriate in the pertinent art, the frames 3 and 6, as well as collars 2, 5, and 8 can be manufactured using any conductive material or combination of materials and can be joined together or otherwise arranged using any suitable method without or with appropriate gaskets.

In other embodiments of the invention, the dielectric plates 4 and 7 can be made using any dielectric material or combination of materials (e.g. quartz with Teflon coating). For example, for improved strength an embodiment may incorporate multi-layer dielectric plates composed of a layer of quartz and a layer of polymer like Teflon, polypropylene or similar material. The plates 4 and 7 must meet the heat, pressure, chemical compatibility, and electromagnetic wave transmission requirements of the use of the invention device 50. The thickness of uniform material plates/windows should be an odd multiple of one half of the dominant wavelength of the incident electromagnetic waves in the plate material. The thickness of non-uniform material (multi-material) plates/windows is determined by first establishing the aggregate dielectric constant for each plate/window. Then the aggregate dielectric constant for each plate/window is used to determine one half of the effective dominant wavelength of the incident electromagnetic waves in the plate. The thickness of the plate/window is then set to an odd multiple of this value.

In other embodiments of the invention, the gap between the dielectric plates 4 and 7 can be filled with any dielectric gas or liquid. The distance between the dielectric plates 4 and 7 should be an odd multiple of one quarter of the dominant wavelength of the incident electromagnetic waves in the gap environment. In other embodiments of the invention, pieces of dielectric material, such as quartz or Teflon, may be inserted into the gap to fine-tune the effective geometry of the gap thus improving the efficiency of the invention device 50.

In other embodiments of the invention, the dielectric plate 4 may be mounted at an angle to the direction of the incident microwaves with the efficiency improved under some circumstances. The angle chosen for some of these embodiments can be the Brewster's angle for interface between the dielectric plate 4 and the vessel's content. The Brewster's angle for the interface of two materials has the following property: if electromagnetic waves are incident under this angle, the electric vector of the reflected waves has no component in the plane of incidence. The Brewster's angle can be calculated by methods well known to a person skilled in the art relevant to this invention.

In other embodiments, the invention can be used without or with additional cooling means.

In other embodiments, the invention can be used with or without a pressure sensing port 11 coupled to the gap between the dielectric plates 4 and 7.

In other embodiments, the invention can be used with the vessel sleeve 1 coated with any conductive material or left uncoated.

As described above with reference to FIGS. 1 and 2, the present invention provides a window device 50, for example, a docking collar between the waveguide and the high-pressure vessel of a microwave powered vaporizer system. The device 50 efficiently transmits the microwave power to vaporize compressed liquid in the vessel 25, provides a good impedance match to the vessel 25, and does not overheat even without a dedicated cooling system. The device 50 must be sufficiently strong structurally to withstand the pressure from the vessel 25 and prevent its depressurization. The device 50 must also be compatible with the content of vessel 25. The structural integrity of device 50 may be monitored with a help of a pressure sensing port 11 and a pressure-sensing device 40.

Thus, although, a dual plate design principle (i.e. the use of two plates) is generally known, the prior art lacks a window device that transmits microwaves with the needed efficiency at the power level, wavelength, pressure, and temperature values achievable by the present invention without resorting to liquid cooling. Further, the prior art devices also lack the means for pressure monitoring provided by the present invention. Accordingly, the present invention provides a device for transmission of electromagnetic waves as heretofore unachieved.

Although not germane to the principles of the present invention, the device 50 in one embodiment has the following dimensions: width about 7.5 inches, height about 5.25 inches, and depth about 14 inches.

While this invention has been particularly shown and described with references to preferred embodiments thereof, it will be understood by those skilled in the art that various changes in form and details may be made therein without departing from the scope of the invention encompassed by the appended claims.

What is claimed is:

1. A device for transmitting electromagnetic waves, for a given characteristic frequency, comprising:

a first layer of dielectric material, the thickness of the first layer being substantially equal to odd multiple of half of the effective wavelength of the electromagnetic waves at the characteristic frequency in the dielectric material of the first layer, a second layer of dielectric material spaced apart by a distance from the first layer of dielectric material, the thickness of the second layer being substantially equal to an odd multiple of half of the effective wavelength of the electromagnetic waves at the characteristic frequency in the dielectric material of the second layer, the distance being substantially equal to an odd multiple of quarter wavelength of the electromagnetic waves at the characteristic frequency within a space between the first layer and the second layer, and a sleeve having an electrically conductive coating on the internal surface thereof, the sleeve being positioned adjacent to the second layer opposite from the first layer.

2. A device as claimed in claim 1 wherein at least one of the first and second layers of dielectric material is polytetrafluoroethylene.

3. A device as claimed in claim 1 wherein the first and second layers of dielectric material are substantially parallel to each other.

4. A device as claimed in claim 1, wherein the device transmits power having the electromagnetic waves with sufficiently high effeciency to allow external air cooling as a sole source of cooling.

5. A device as claimed in claim 1 wherein the electrically conductive coating is gold.

6. A device as claimed in claim 1 wherein the device transmits power with the electromagnetic waves in the microwave range with an efficiency rate of at least about 95%.

7. A device as claimed in claim 1 wherein at least one of the first and second layers of dielectric material is quartz.

8. A device as claimed in claim 1 further comprising a pressure sensor coupled to the space between the first layer and the second layer for detecting pressure breach within the space between the first layer and the second layer.

9. A device for transmitting electromagnetic waves, for a given characteristic frequency, comprising:

a first layer of dielectric material, the thickness of the first layer being substantially equal to an odd multiple of half of the effective wavelength of the electromagnetic waves at the characteristic frequency in the dielectric material of the first layer, a second layer of dielectric material spaced apart by a distance from the first layer of dielectric material, the thickness of the second layer being substantially equal to an odd multiple of half of the effective wavelength of the electromagnetic waves at the characteristic frequency in the dielectric material of the second layer, the distance being substantially equal to an odd multiple of quarter wavelength of the electromagnetic waves at the characteristic frequency within a space between the first layer and the second layer, and a pressure sensor coupled to the space between the first layer and the second layer for detecting pressure breach within the space between the first layer and the second layer.

10. A device as claimed in claim 9, wherein the device transmits power with the electromagnetic waves with sufficiently high efficiency to allow external air cooling as a sole source of cooling.

11. A device as claimed in claim 9 further comprising a sleeve having an electrically conductive coating on the internal surface thereof, the sleeve being positioned adjacent to the second layer opposite from the first layer.

12. A device as claimed in claim 11 wherein the electrically conductive coating is gold.

13. A device as claimed in claim 9 wherein the device transmits power with the electromagnetic waves in the microwave range and with an efficiency rate of at least about 95%.

14. A device as claimed in claim 9 wherein at least one of the first and second layers of dielectric material is quartz.

15. A device as claimed in claim 9 wherein at least one of the first and second layers of dielectric material is polytetrafluoroethylene.

16. A device as claimed in claim 9 wherein the first and second layers of dielectric material are substantially parallel to each other.

* * * * *